US007847474B2

(12) United States Patent
Seon

(10) Patent No.: US 7,847,474 B2
(45) Date of Patent: Dec. 7, 2010

(54) VACUUM ENVELOPE AND ELECTRON EMISSION DISPLAY HAVING THE VACUUM ENVELOPE

(75) Inventor: Hyeong-Rae Seon, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 457 days.

(21) Appl. No.: 11/586,314

(22) Filed: Oct. 24, 2006

(65) Prior Publication Data

US 2007/0090760 A1 Apr. 26, 2007

(30) Foreign Application Priority Data

Oct. 25, 2005 (KR) ..... 10-2005-0100657

(51) Int. Cl.

| | |
|---|---|
| ***H01J 1/62*** | (2006.01) |
| ***H01J 63/04*** | (2006.01) |
| ***H01J 1/18*** | (2006.01) |
| ***H01K 1/18*** | (2006.01) |

(52) U.S. Cl. ..... 313/495; 313/496; 313/497; 313/292; 313/238

(58) Field of Classification Search ..... None
See application file for complete search history.

(56) References Cited

U.S. PATENT DOCUMENTS

| | | | | |
|---|---|---|---|---|
| 6,113,450 | A | 9/2000 | Narayanan et al. | |
| 7,429,819 | B2 * | 9/2008 | Kijima et al. | 313/292 |
| 7,501,751 | B2 * | 3/2009 | Kijima et al. | 313/496 |
| 2003/0071562 | A1 | 4/2003 | Ando | |
| 2005/0179362 | A1 | 8/2005 | Kijima et al. | |
| 2006/0077626 | A1 | 4/2006 | Masuoka et al. | |
| 2006/0244363 | A1 * | 11/2006 | Seon et al. | 313/495 |

FOREIGN PATENT DOCUMENTS

| | | |
|---|---|---|
| CN | 1655317 A | 8/2005 |
| CN | 1684576 A | 10/2005 |
| EP | 1 729 318 A1 | 12/2006 |
| JP | 11-111234 | 4/1999 |
| JP | 2002-515392 | 5/2002 |
| JP | 2005-056818 | 3/2005 |
| JP | 2005-203376 | 7/2005 |
| JP | 2005-222895 | 8/2005 |
| JP | 2005-302565 | 10/2005 |
| WO | WO 95/20821 | 8/1995 |
| WO | WO 99/59180 | 11/1999 |

OTHER PUBLICATIONS

Patent Abstracts of Japan, Publication No. 11-111234, dated Apr. 23, 1999, in the name of Tadahiko Muroi et al.
European Search Report dated Feb. 5, 2007, for EP 06122819.3, in the name of Samsung SDI Co., Ltd.

* cited by examiner

*Primary Examiner*—Nimeshkumar D. Patel
*Assistant Examiner*—Natalie K Walford
(74) *Attorney, Agent, or Firm*—Christie, Parker & Hale, LLP

(57) ABSTRACT

A vacuum envelope and an electron emission display having the vacuum envelope. The vacuum envelope includes a first substrate and a second substrate facing the first substrate. A plurality of frames is arranged between the first substrate and the second substrate to form an inner vacuum space. An absorbing member is arranged between at least two of the frames.

19 Claims, 7 Drawing Sheets

VACUUM ENVELOPE AND ELECTRON EMISSION DISPLAY HAVING THE VACUUM ENVELOPE

CROSS-REFERENCE TO RELATED APPLICATION

This application claims priority to and the benefit of Korean Patent Application No. 10-2005-0100657, filed on Oct. 25, 2005, in the Korean Intellectual Property Office, the entire content of which is incorporated herein by reference.

BACKGROUND OF THE INVENTION

1. Field of the Invention

The present invention relates to a vacuum envelope and an electron emission display having the vacuum envelope, and more particularly, to a vacuum envelope having a sealing structure and an electron emission display having the vacuum envelope.

2. Description of Related Art

In general, electron emission elements can be classified into those using hot cathodes as an electron emission source and those using cold cathodes as an electron emission source.

There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

Electron emission elements are arrayed (or arranged) on a first substrate to form an electron emission device. The electron emission device is combined with a second substrate, on which a light emission unit having phosphor layers and an anode electrode is arranged, to make an electron emission display.

That is, a conventional electron emission device includes electron emission regions and a plurality of driving electrodes functioning as scan and data electrodes. By operating the electron emission regions and the driving electrodes, an on/off operation of each pixel and an amount of electron emission are controlled. A conventional electron emission display excites phosphor layers using electrons emitted from the electron emission regions to display a certain (or predetermined) image.

The electron emission display includes an electron emission unit and a light emission unit that are arranged in a vacuum envelope (or chamber). In order to allow the electron emission unit to effectively operate, it is essential to maintain an airtightness of the vacuum envelope.

The vacuum envelope includes a first substrate and a second substrate facing the first substrate, the first substrate and the second substrate being spaced apart from each other. A glass frame is arranged between the first substrate and the second substrate. The glass frame is adhered to the first substrate and the second substrate by frit.

The glass frame includes a plurality of sections that are adhered to each other by frit. When the sections of the glass frame have different lengths, the sections also have different levels of thermal expansivity. Therefore, the sections contract or expand during a firing process, and thus a shape or shapes of the first substrate and/or the second substrate may be distorted and/or the sections of the glass frame may move away from desired positions. This causes the airtightness of the vacuum envelope to be deteriorated.

SUMMARY OF THE INVENTION

An aspect of the present invention provides a vacuum envelope that can compensate for a contraction and/or an expansion that may occur because sections of a glass frame have different levels of thermal expansivity and that can, therefore, improve an airtightness of the vacuum envelope.

Another aspect of the present invention provides an electron emission display having the vacuum envelope.

According to an embodiment of the present invention, a vacuum envelope includes a first substrate and a second substrate facing the first substrate. A plurality of frames is arranged between the first substrate and the second substrate to form an inner vacuum space. An absorbing member is arranged between at least two of the frames.

The frames may include a first longitudinal frame, a second longitudinal frame, a first lateral frame, and a second lateral frame.

The absorbing member may interconnect an end of the first longitudinal frame and an end of the first lateral frame, the end of the first lateral frame being adjacent to the end of the longitudinal frame.

The absorbing member may be perpendicularly bent.

A height of the absorbing member may be substantially equal to a height of the frames. A width of the absorbing member may be substantially equal to a width of the frames.

The absorbing member may be configured to have a shape of a rectangular column. The absorbing member may be configured to have a shape of a circular column.

The frames may be formed of glass. The absorbing member may be formed of frit.

In another embodiment of the present invention, an electron emission display includes a first substrate and a second substrate facing the first substrate. An electron emission unit is arranged on the first substrate, and a light emission unit is arranged on the second substrate. A plurality of frames is arranged between the first substrate and the second substrate to form an inner vacuum space. An absorbing member is arranged between at least two of the frames.

The frames may include a first longitudinal frame, a second longitudinal frame, a first lateral frame, and a second lateral frame. The absorbing member may connect an end of the first longitudinal frame to an end of the first lateral frame to perpendicularly couple the first longitudinal frame and the first lateral frame.

The electron emission unit may include a plurality of electron emission regions, a plurality of cathode electrodes, and a plurality of gate electrodes. The cathode electrodes and the gate electrodes may be adapted to control the electron emission regions and may be insulated from each other. The light emission unit may include a plurality of phosphor layers, a black layer arranged between at least two of the phosphor layers, and an anode electrode arranged on the phosphor layers and the black layer.

The electron emission regions may include a material selected from the group consisting of carbon nanotubes, graphite, graphite nanofibers, diamonds, diamond-like carbon, $C_{60}$, silicon nanowires, and combinations thereof.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF INVENTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
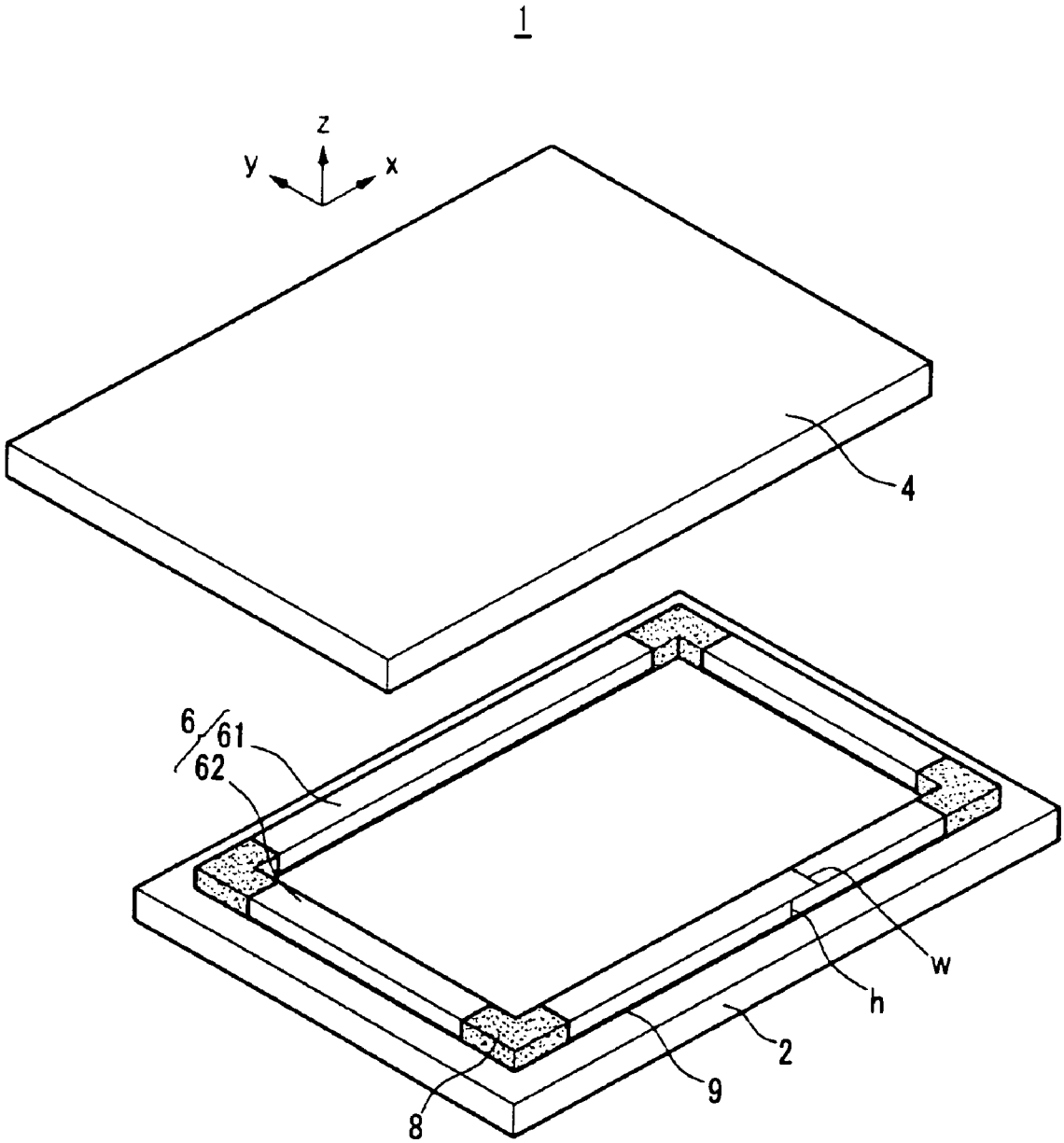
FIG. 1 is an exploded perspective view of a vacuum envelope according to an embodiment of the present invention.
Figure 2:
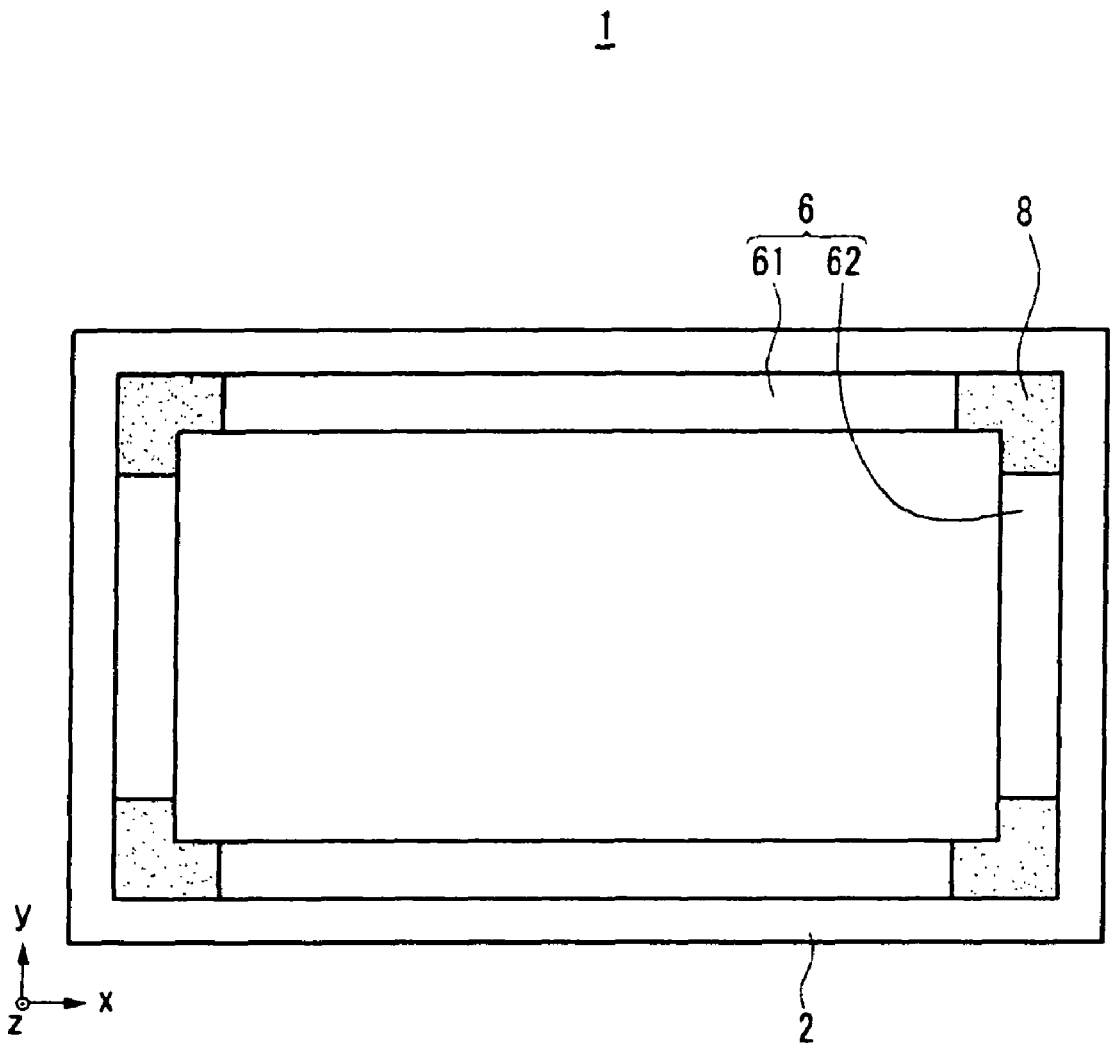
FIG. 2 is a partial top view of the vacuum envelope shown in FIG. 1.

FIGS. 1 and 2 show a vacuum envelope according to an embodiment of the present invention.

Referring to FIGS. 1 and 2, a vacuum envelope 1 includes a first substrate 2 and a second substrate 4 facing the first substrate 2. The first substrate 2 and the second substrate 4 are spaced apart from each other at a certain (or predetermined) interval. Frames 6 are arranged along respective peripheries (or peripheral regions) of the first substrate 2 and the second substrate 4, thereby forming a vacuum space.

The frames 6 include (or can be categorized into) a pair of longitudinal frames (or sections) 61 and a pair of lateral frames (or sections) 62. That is, the longitudinal frames 61 and the lateral frames 62 are arranged to have a rectangular shape. By way of example, the frames 6 may be formed of glass.

Absorbing (or compensating) members 8 are arranged to interconnect adjacent ends of the longitudinal frames and the lateral frames. That is, one of the absorbing members 8 is arranged to interconnect an end of one of the longitudinal frames 61 and an end of one of the lateral frames 62, the end of the one of the lateral frames 62 being adjacent to the end of the one of the longitudinal frames 61. As shown in FIG. 1, the absorbing members 8 are respectively arranged at the four corners of the rectangular shape which the frames 6 are arranged to have. In other words, each of the frames 6 (e.g., each of the frames 61, 62) is arranged between at least two of the absorbing members 8, and the absorbing members 8 are respectively arranged at the four corners (or corner regions) of the first substrate 2.

As shown in FIG. 2, each of the absorbing members 8 is configured to have a shape of a letter 'L' and to have a horizontal section and a vertical section. The horizontal section of one of the absorbing members 8 is connected to one of the longitudinal frames 61, and the vertical section of one of the absorbing members 8 is connected to one of the lateral frames 62. A height of the one of the absorbing members 8 may be substantially equal (or identical) to a height h of the frames 6 (see, for example, FIG. 1). A width of the one of the absorbing members 8 may be substantially equal to a width w of the frames 6 (see, for example, FIG. 1).

The absorbing members 8 compensate for a contraction and/or an expansion of the frames 6 to prevent or restrain the first substrate 2 and the second substrate 4 from being substantially distorted in shape or moving away from desired positions. For example, when one of the longitudinal frames 61 expands along a first direction (e.g., a direction of an x-axis in FIG. 1) and an adjacent one of the lateral frames 62 expands along a second direction (e.g., a direction of a y-axis in FIG. 1), a corresponding one of the absorbing members 8 contracts along the first direction and the second direction in response to the respective expansions of the one of the longitudinal frames 61 and the adjacent one of the lateral frames 62. Therefore, the absorbing members 8 have an elastic property as well as an adhesive property. By way of example, the absorbing members 8 may be formed of frit.

In order to form the absorbing members 8 using frit, a frit powder is first filled in a mold, and the frit powder filled in the mold is heated at a high temperature. Then, the heated frit powder is hardened as (or to form) a single body (e.g., one of the absorbing members 8). The absorbing members 8 are arranged between the frames 6. During a firing process, the absorbing members 8 are melted (or caused to be in a molten state) to compensate for thermal expansions of the frames 6.

The shape which the absorbing members 8 are configured to have and the material of which the absorbing members 8 are formed are not limited to the case described above. That is, absorbing members may be configured to have any suitable shape and formed of any suitable material such that the absorbing members can be properly arranged at corners of a shape according to which frames are arranged and can properly compensate for a thermal expansion and/or contraction of the frames.

Adhesive layers 9 are respectively arranged between the frames 6 and the first substrate 2 and between the frames 6 and the second substrate 4 such that the frames 6 are bonded to the first substrate 2 and the second substrate 4. The adhesive layer 9 may be formed of frit.

Figure 3:
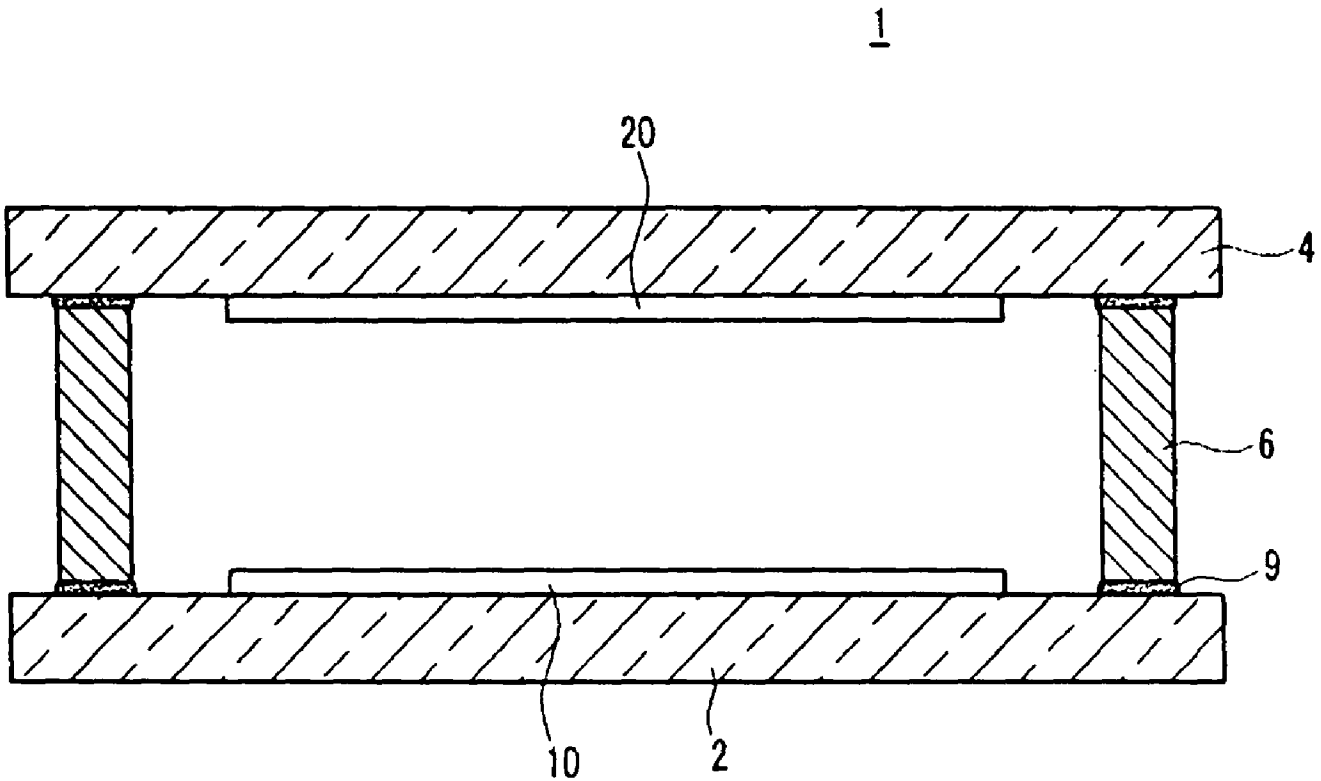
FIG. 3 is a partial sectional view of an electron emission display of an embodiment of the present invention having the vacuum envelope shown in FIG. 1.

FIG. 3 shows an electron emission display according to an embodiment of the present invention, the electron emission display having the vacuum envelope 1 shown in FIGS. 1 and 2.

As shown in FIG. 3, the vacuum envelope shown in FIGS. 1 and 2 can be applied to an electron emission display.

An electron emission unit 10 on which electron emission elements are arrayed (or arranged) is arranged on a surface of the first substrate 2, thereby forming an electron emission device. The electron emission device is combined with the second substrate 4, on which a light emission unit 20 is arranged, to form the electron emission display.

Figure 4:
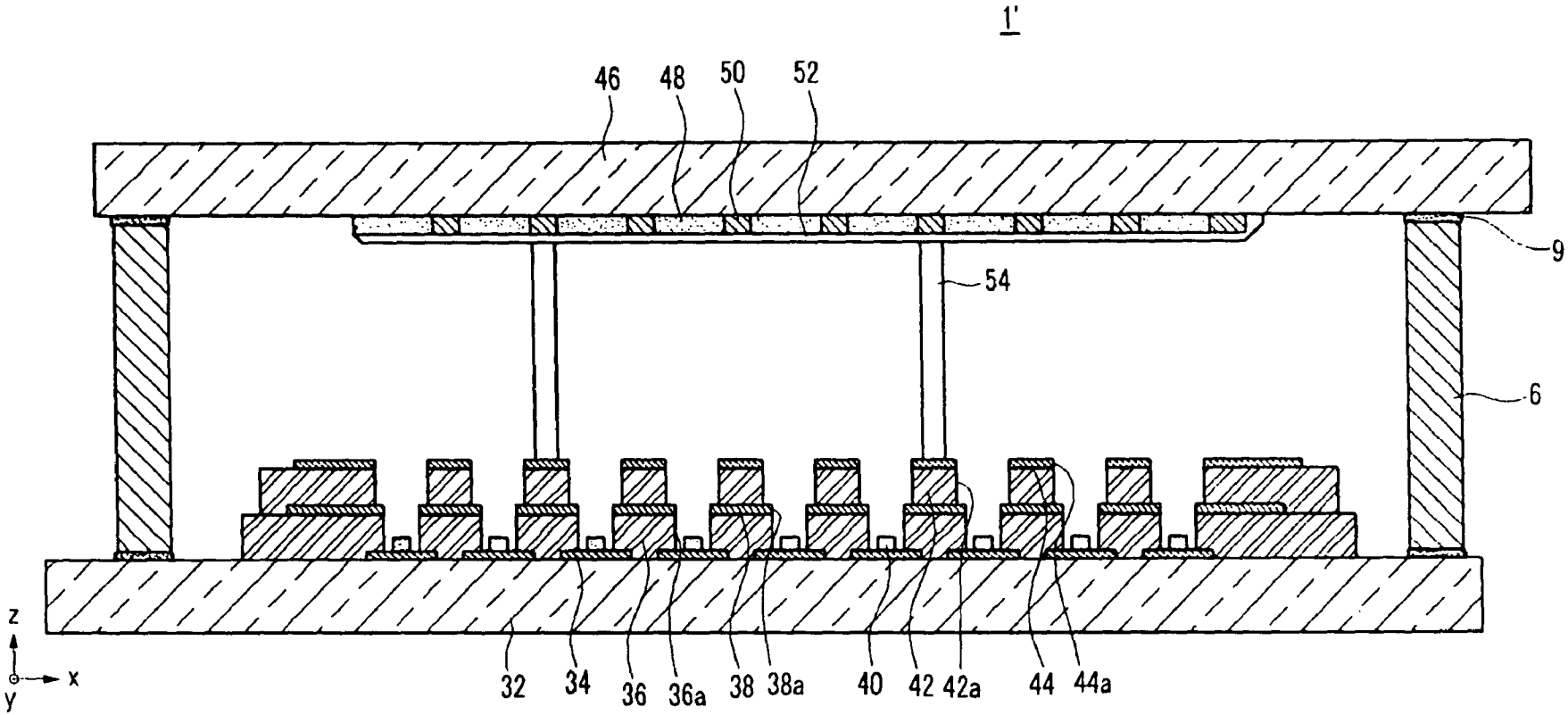
FIG. 4 is a sectional view of an electron emission display having an array of FEA elements according to an embodiment of the present invention.

FIG. 4 shows an electron emission display having an array of FEA elements. FIG. 4 illustrates an electron emission unit according to another embodiment of the present invention. The vacuum envelope shown in FIGS. 1 and 2 is also applied to the electron emission display 1' of this embodiment.

Referring to FIG. 4, a plurality of cathode electrodes 34 are formed on a first substrate 32 in a striped pattern to extend along a first direction (a direction of a y-axis in FIG. 4). A first insulation layer 36 is arranged on an entire surface of the first substrate 32 to cover the cathode electrodes 34. A plurality of gate electrodes 38 are arranged on the first insulation layer 36 in a striped pattern to extend along a second direction (a direction of an x-axis in FIG. 4) to cross the cathode electrodes 34 at right angles.

One or more electron emission regions 40 are arranged on the cathode electrodes 36 at each crossing region of the cathode electrodes 34 and the gate electrodes 38. In addition, first openings 36*a* and second openings 38*a* corresponding to the electron emission regions 40 are respectively formed on the first insulation layer 36 and the gate electrodes 38 to expose the electron emission regions 40.

The electron emission regions 40 may be formed of a material which emits electrons when an electric field is applied thereto in a vacuum atmosphere. By way of example, the material may be a carbonaceous material and/or a nanometer-sized material. For example, the electron emission regions 40 may be formed of carbon nanotubes, graphite, graphite nanofibers, diamonds, diamond-like carbon, $C_{60}$, silicon nanowires, and/or combinations thereof.

A second insulation layer 42 and a focusing electrode 44 are sequentially arranged on the gate electrodes 38 and the first insulation layer 36. Openings 42*a* and 44*a* for allowing electron beams to pass are respectively formed on the second insulation layer 42 and the focusing electrode 44. The openings 42*a* and 44*a* are arranged to correspond to each crossing region (e.g., each pixel region) to focus electrons emitted from each electron emission region (or for each pixel).

Although a case where the gate electrodes 38 are arranged above the cathode electrodes 34 with the first insulation layer 36 arranged therebetween is described, embodiments of the present invention are not limited to this case. For example, the cathode electrodes 34 may be arranged above the gate electrodes 38 with the first insulation layer 36 arranged therebetween. In this case, the electron emission regions may be formed on (or connected with) the cathode electrodes 34 arranged above the gate electrodes 38.

On a surface of a second substrate 46 facing the first substrate 32, phosphor layers 48 (e.g., red, green and blue phosphor layers 48R, 48G and 48B) are arranged and spaced apart from each other at certain (or predetermined) intervals. One of black layers 50 is formed between at least two of the phosphor layers 48 to improve a contrast of a displayed image. An anode electrode 52 formed of a conductive material such as aluminum is arranged on the phosphor layers 48 and the black layers 50. The anode electrode 52 heightens a screen luminance by receiving a high voltage required for accelerating electron beams and reflecting visible light rays radiated from the phosphor layers 48 to the first substrate 32 back toward the second substrate 46.

Arranged between the first substrate 32 and the second substrate 46 are a plurality of spacers 54 for uniformly maintaining a gap between the first substrate 32 and the second substrate 46.

Figure 5:
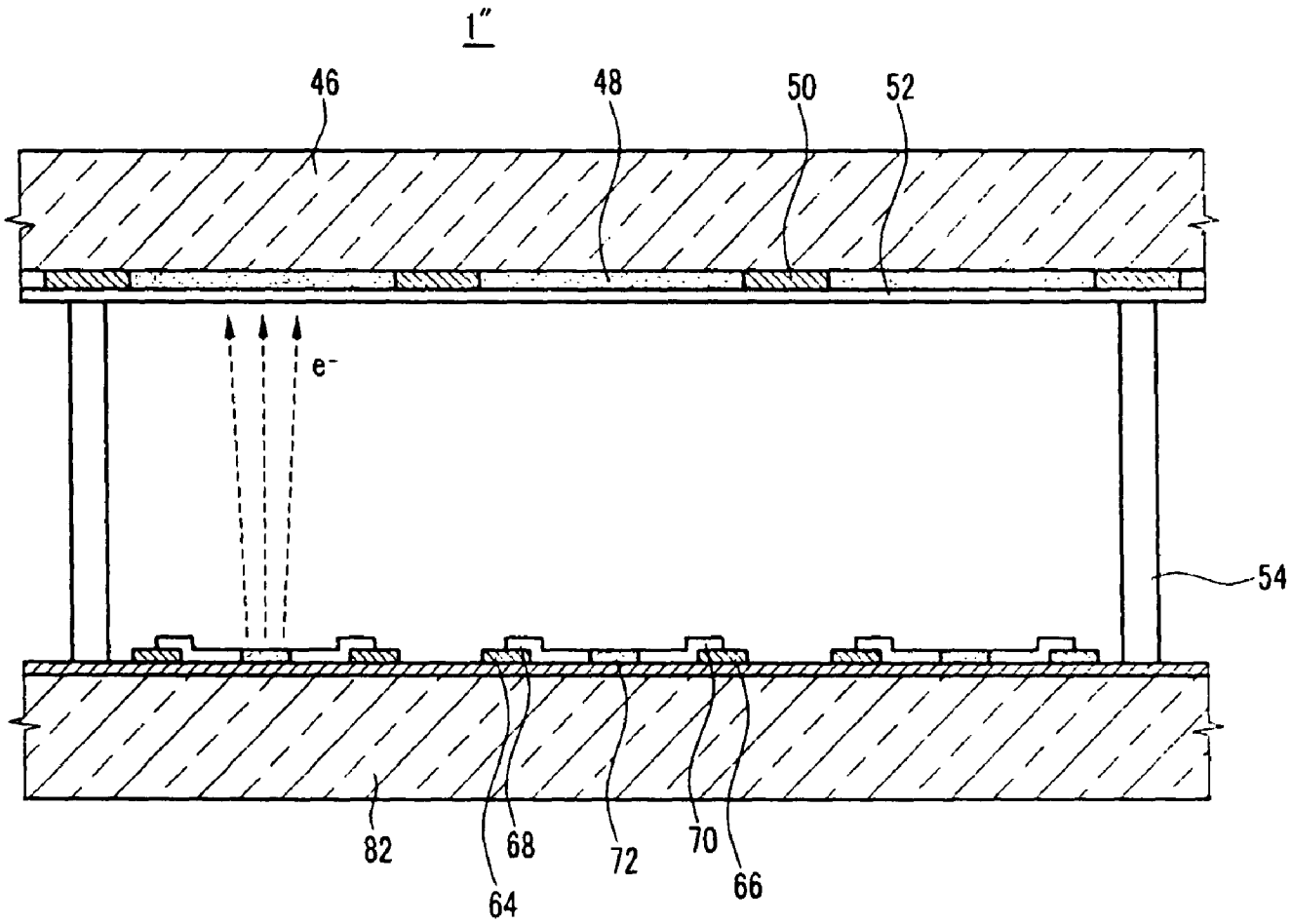
FIG. 5 is a sectional view of an electron emission display having an array of SCE elements according to an embodiment of the present invention.

FIG. 5 shows an electron emission display having an array of SCE elements according to another embodiment of the present invention. The vacuum envelope 1 shown in FIGS. 1 and 2 can also be applied to the electron emission display 1" of this embodiment.

Referring to FIG. 5, first electrodes 64 and second electrodes 66 are arranged on a first substrate 82, and a first conductive layer 68 and a second conductive layer 70 are arranged to partly cover respective surfaces of the first electrodes 64 and the second electrodes 66, respectively. Electron emission regions 72 are arranged between the first conductive layer 68 and the second conductive layer 70 and are electrically connected to the first conductive layer 68 and the second conductive layer 70. The electron emission regions 72 are electrically connected to the first electrodes 64 and the second electrodes 66 through the first conductive layer 68 and the second conductive layer 70, respectively.

The first electrodes 64 and the second electrodes 66 may be formed of any of a variety of suitable conductive materials, and the first conductive layer 68 and the second conductive layer 70 may be formed of a conductive material such as Ni, Au, Pt, and/or Pd.

The electron emission regions 72 may be formed of carbon nanotubes, graphite, graphite nanofibers, diamonds, diamond-like carbon, $C_{60}$, silicon nanowires, and/or combinations thereof.

Figure 6:
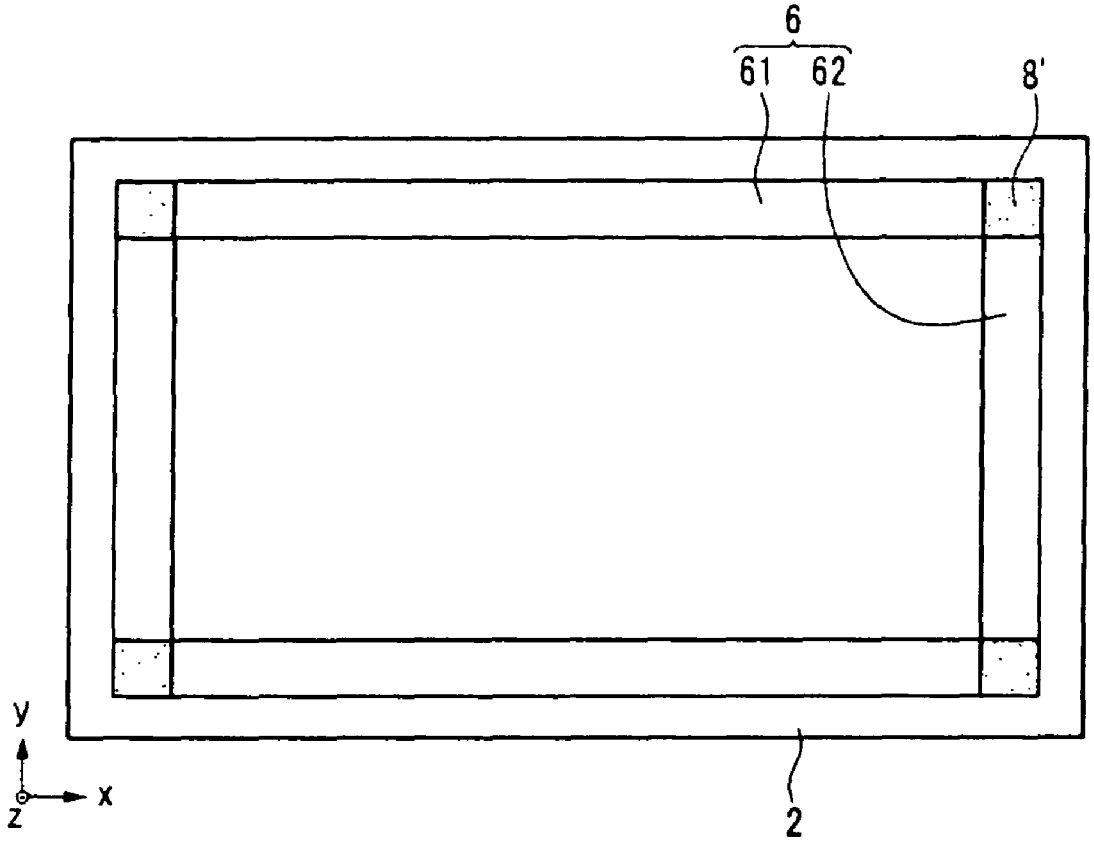
FIG. 6 is a partial top view of a vacuum envelope according to another embodiment of the present invention.

FIG. 6 shows a vacuum envelope according to another embodiment of the present invention.

Referring to FIG. 6, one of absorbing members 8' of this embodiment is configured to have a shape of a rectangular column (e.g., a rectangular column having a rectangular cross section).

The absorbing members 8' compensate for a contraction and/or an expansion of the frames 6 to prevent or restrain substrates from being substantially distorted in shape or moving away from desired positions.

Figure 7:
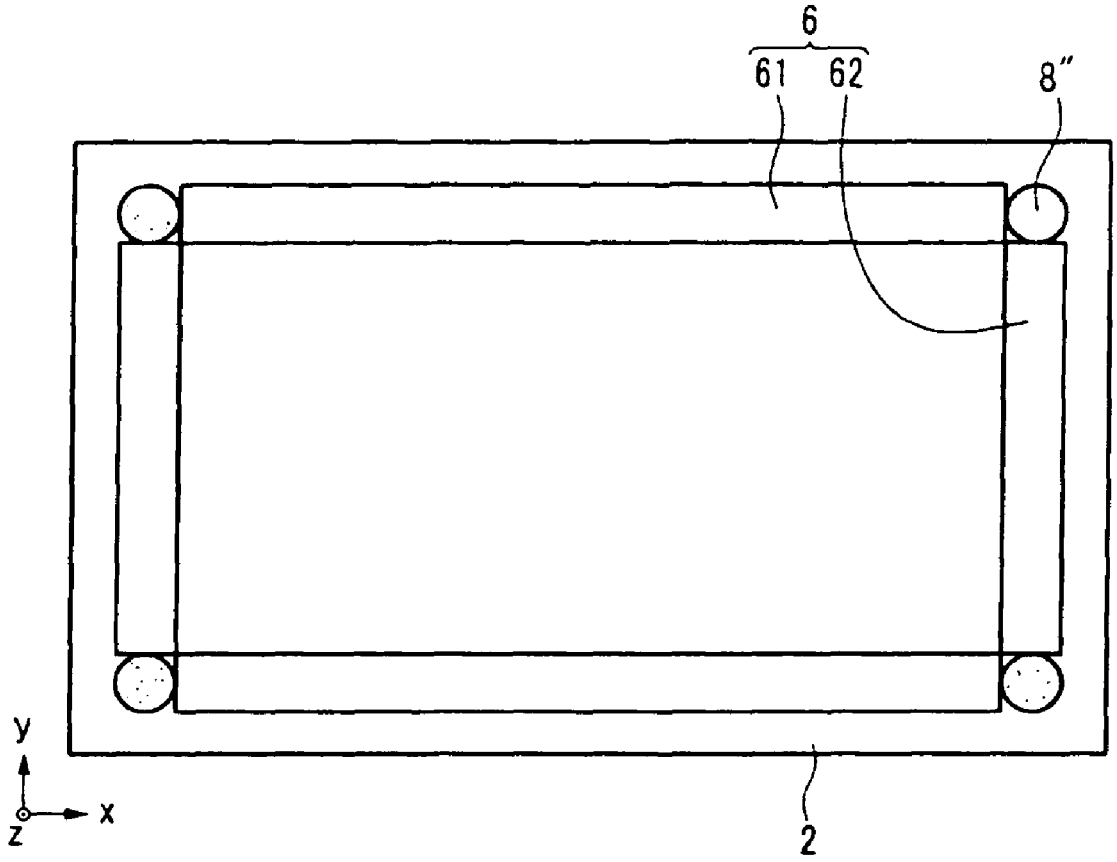
FIG. 7 is a partial top view of a vacuum envelope according to another embodiment of the present invention.

FIG. 7 shows a vacuum envelope according to another embodiment of the present invention.

Referring to FIG. 7, one of absorbing members 8" of this embodiment is configured to have a shape of a circular column (e.g., a circular column having a circular cross section).

Similar to the embodiment shown in FIG. 6, the absorbing members 8" compensate for a contraction and/or an expansion of the frames 6 to prevent substrates from being substantially distorted in shape or moving away from desired positions.

As described above and as shown in FIGS. 2, 6 and 7, a absorbing member may be configured to have any of a variety of suitable shapes.

In described embodiments, a vacuum envelope of embodiments of the present invention is applied to an electron emission display having an array of FEA elements, and a vacuum envelope of embodiments of the present invention is applied to an electron emission display having SCE elements. However, embodiments of the present invention are not limited to these examples. That is, a vacuum envelope of embodiments of the present invention can also be applied to an electron emission display having an array of MIM elements and/or MIS elements.

According to embodiments of the present invention, since the absorbing members compensate for the contraction and/or the expansion of the frames, the substrates are not substantially distorted in shape or moved away from desired positions.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A vacuum envelope, comprising:

a first substrate;

a second substrate facing the first substrate;

a plurality of frames arranged between the first substrate and the second substrate to form an inner vacuum space, the frames comprising a first lateral frame and a first longitudinal frame; and an absorbing member arranged between the first lateral frame and the first longitudinal frame, the absorbing member connecting to the first longitudinal frame at a right angle with respect to the first substrate, and connecting to the first lateral frame at a right angle with respect to the first substrate.

2. The vacuum envelope of claim 1, wherein the frames further comprise a second longitudinal frame and a second lateral frame.

3. The vacuum envelope of claim 2, wherein the absorbing member interconnects an end of the first longitudinal frame and an end of the first lateral frame, the end of the first lateral frame being adjacent to the end of the first longitudinal frame.

4. The vacuum envelope of claim 3, wherein the absorbing member is configured to have a shape of a letter 'L,' with a horizontal section connected to the first longitudinal frame and a vertical section connected to the first lateral frame.

5. The vacuum envelope of claim 3, wherein the absorbing member is configured to have a shape of a rectangular column.

6. The vacuum envelope of claim 3, wherein the absorbing member is configured to have a shape of a circular column.

7. The vacuum envelope of claim 1, wherein the frames are formed of glass.

8. The vacuum envelope of claim 1, wherein the absorbing member is formed of frit.

9. An electron emission display, comprising:

a first substrate;

a second substrate facing the first substrate;

an electron emission unit arranged on the first substrate;

a light emission unit arranged on the second substrate;

a plurality of frames arranged between the first substrate and the second substrate to foam an inner vacuum space, the frames comprising a first lateral frame and a first longitudinal frame; and an absorbing member arranged between the first lateral frame and the first longitudinal frame, the absorbing member connecting to the first longitudinal frame at a right angle with respect to the first substrate, and connecting to the first lateral frame at a right angle with respect to the first substrate.

10. The electron emission display of claim 9, wherein the absorbing member is fanned of frit, and wherein the frames are formed of glass.

11. The electron emission display of claim 10, wherein the frames further comprise a second longitudinal frame and a second lateral frame.

12. The electron emission display of claim 11, wherein the absorbing member connects an end of the first longitudinal frame to an end of the first lateral frame to perpendicularly couple the first longitudinal frame and the first lateral frame.

13. The electron emission display of claim 12, wherein a height of the absorbing member is substantially equal to a height of the frames, and wherein a width of the absorbing member is substantially equal to a width of the frames.

14. The electron emission display of claim 9, wherein the electron emission unit comprises a plurality of electron emission regions, a plurality of cathode electrodes, and a plurality of gate electrodes, the cathode electrodes and the gate electrodes being adapted to control the electron emission regions and being insulated from each other, and wherein the light emission unit comprises a plurality of phosphor layers, a black layer arranged between at least two of the phosphor layers, and an anode electrode arranged on the phosphor layers and the black layer.

15. The electron emission display of claim 14, wherein the electron emission regions comprise a material selected from the group consisting of carbon nanotubes, graphite, graphite nanofibers, diamonds, diamond-like carbon, $C_{60}$, silicon nanowires, and combinations thereof.

16. The electron emission display of claim 12, wherein the absorbing member is configured to have a shape of a rectangular column.

17. The electron emission display of claim 12, wherein the absorbing member is configured to have a shape of a circular column.

18. The vacuum envelope of claim 4, wherein a height of the absorbing member is substantially equal to a height of the frames, and wherein a width of the absorbing member is substantially equal to a width of the frames.

19. The electron emission display of claim 12, wherein the absorbing member is configured to have a shape of a letter 'L,' with a horizontal section connected to the first longitudinal frame and a vertical section connected to the first lateral frame.

* * * * *

UNITED STATES PATENT AND TRADEMARK OFFICE

CERTIFICATE OF CORRECTION

PATENT NO. : 7,847,474 B2
APPLICATION NO. : 11/586314
DATED : December 7, 2010
INVENTOR(S) : Hyeong-Rae Seon It is certified that error appears in the above-identified patent and that said Letters Patent is hereby corrected as shown below:

In the Claims

| | |
|---|---|
| Column 7, Claim 9, line 29 | Delete "foam"<br>Insert -- form -- |
| Column 7, Claim 10, line 39 | Delete "fanned"<br>Insert -- formed -- |

Signed and Sealed this
Fifteenth Day of November, 2011

David J. Kappos

David J. Kappos
*Director of the United States Patent and Trademark Office*